US006011470A

United States Patent [19]

Schulte et al.

[11] Patent Number: 6,011,470

[45] Date of Patent: Jan. 4, 2000

[54] ULTRASOUND KEYBOARD PROTECTION

[76] Inventors: Johannes Schulte, Tinkhofstrasse 29, Waltrop, Germany, 45731; Oliver Liedtke, Schlagbaumstrasse 21, Dortmund, Germany, 44287

[21] Appl. No.: 09/117,971

[22] PCT Filed: Feb. 12, 1997

[86] PCT No.: PCT/EP97/00643

§ 371 Date: Aug. 7, 1998

§ 102(e) Date: Aug. 7, 1998

[87] PCT Pub. No.: WO97/29499

PCT Pub. Date: Aug. 14, 1997

[30] Foreign Application Priority Data

Feb. 12, 1996 [DE] Germany ..... 196 05 092

[51] Int. Cl.[7] ..... G08B 13/18

[52] U.S. Cl. ..... 340/552; 340/825.3; 340/540; 367/93; 367/95

[58] Field of Search ..... 340/552–554, 340/541, 540, 825.3; 341/22; 364/709.05; 367/93, 94, 95

[56] References Cited

U.S. PATENT DOCUMENTS

| | | | |
|---|---|---|---|
| 5,149,986 | 9/1992 | Jalbert | 341/20 |
| 5,438,318 | 8/1995 | Latorre et al. | 340/554 |
| 5,757,271 | 5/1998 | Andrews | 340/568 |

FOREIGN PATENT DOCUMENTS 91 05 845 U 8/1991 Germany .

*Primary Examiner*—Daniel J. Wu
*Attorney, Agent, or Firm*—Rader, Fishman, Grauer & McGarry

[57] ABSTRACT

An apparatus for protecting a keyboard and includes a sound transformer placed in the keyboard and a sound receiver placed outside the keyboard to receive a signal radiated from the sound transformer. The signal is then analyzed to determine if the power of the radiated signal has dropped below a threshold value, indicating potential tampering of the keyboard.

38 Claims, 1 Drawing Sheet

ULTRASOUND KEYBOARD PROTECTION

BACKGROUND OF THE INVENTION

1. Field of the Invention

The invention relates to the detection of an object covering the surface of a keyboard.

2. Related Art

Self-operating apparatuses have, as a rule, a keyboard on which the user inputs confidential or secret data, especially a secret number designated as PIN (personal identification number). In order to access these and similar data illegally, a keyboard can be manipulated by superposed similar keyboards or other objects. An arrangement which discovers such manipulations must, however, simultaneously be unobtrusive, sturdy, and be secured against wanton damage (vandalism).

It is the problem of the invention, therefore, to give a corresponding arrangement.

SUMMARY OF THE INVENTION

The invention solves the problem by a sound generator, preferably a sound generator, mounted in the interior of the keyboard. The generator radiates a signal, preferably ultrasonic waves, through the surface of the keyboard. Above the keyboard there can be mounted a receiver which detects the radiated ultrasonic waves and, accordingly, signals a proper state after processing the signal with an evaluating circuit connected to a control that can block the keyboard or an apparatus containing the keyboard in response to an improper state. The protective arrangement is thus unobtrusive and, further, protected against vandalism.

DETAILED DESCRIPTION

Figure 1:
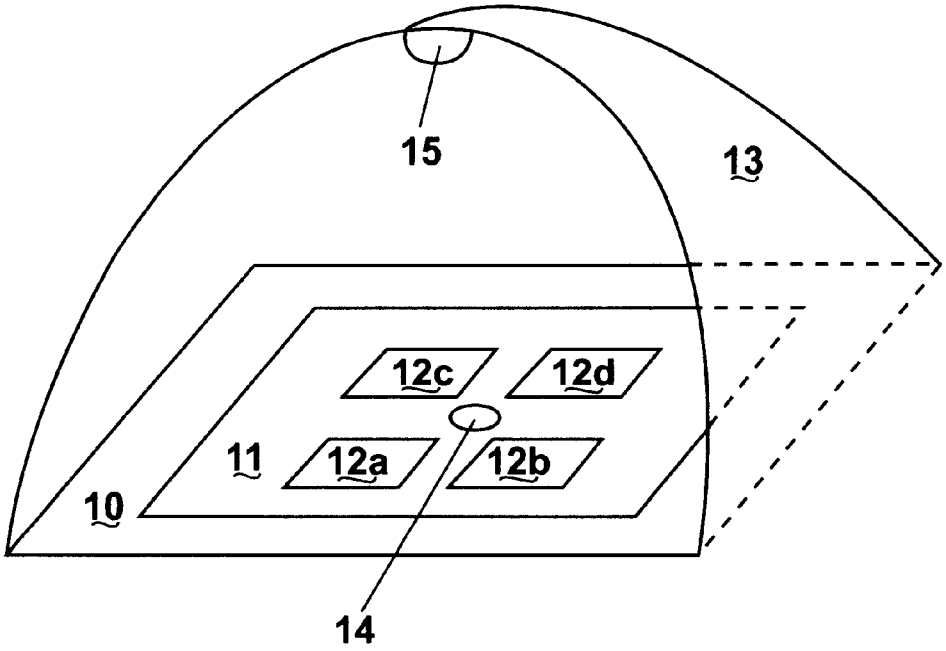
FIG. 1 shows an arrangement of a keyboard with ultrasonic transmitter and receiver.

Much simplified, and schematically, there is shown in FIG. 1 a keyboard on base plate 10 under a hood 13. The keyboard consists of a key frame 11 and individually keys 12*a–d*. In the interior of the keyboard there is mounted on the underside of the keyboard frame 11 on a bridge between the keys 12*a–d*, an ultrasonic transmitter 14, which is electrically actuated. Above the keyboard, in the example in the hood 13 protecting the keyboard, an ultrasonic receiver 15 is mounted. The signal received by it is amplified, rectified and fed to a threshold value detector.

These arrangements are executed in a known manner and are not represented in FIG. 1. The output of the threshold value detector is connected with a control unit for the apparatus using the keyboard as input apparatus. As long as the detector for the threshold value of the control unit reports the presence of a signal, the apparatus is ready for operation, and it uses the keyboard as input apparatus.

A sheet of paper laid on the keyboard already dampens the relation of the ultrasonic generator 14 significantly. The threshold value detector therefore alters its signal to the control unit, which reacts correspondingly. If the apparatus is in the state of readiness for operation, then a loss of the ultrasonic transmission reported by the threshold value detector is interpreted as manipulation, and the apparatus is shifted into a disturbance state. This does not hold if a user was just then asked to input data, since the weakening can originate from the hand of the user. The apparatus is protected, therefore, by the means that before the start of each transaction by an operator of the keyboard, the threshold value detector must report the presence of a signal. There the ultrasonic generator in the keyboard is preferably mounted on the inner surface of a key or of a key frame. In many cases the material is acoustically thin enough so that from the keyboard, without further measures, a well-detectable signal is radiated, without the presence of the ultrasound generator becoming visible. Since the surface of the keyboard is undisturbed, neither can it be simply perceived where the signal is radiated, so that attempts at manipulation are made difficult.

Figure 2:
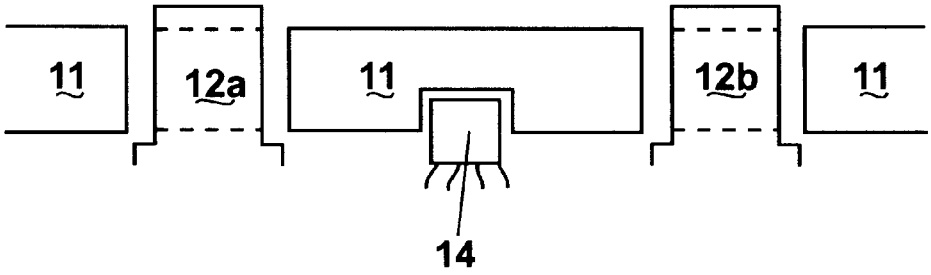
FIG. 2 shows a possible arrangement of an ultrasonic transmitter in the frame of a keyboard.

In keyboards with solid metal keyboard frame, in correspondence to FIG. 2, into a bridge of the key frame 11 a blind hole is made from inside, so that the ultrasonic waves can emerge through the remaining material. Since it is a matter of a blind hole, the surface remains unaltered. Into the blind hole, as ultrasound generator, there is admitted and cemented a piezo ceramic platelet which is provided in a known manner with electrical contacts and connections that are themselves connected with an alternating voltage source of suitable frequency. Therewith there arises a transformer radiation ultrasonic, which is not visible and not manipulable from outside. With suitable dimensions of the blind hole, this hole amplifies the signal by resonance, especially when there are used a piezo transformer with radial oscillations, an oscillation frequency of 40 kHz, a hole diameter of 12 mm, and a cover 0.6 mm in thickness the material of which is aluminum.

Instead of the key frame 11 there can also be used a key, especially a blind key. This is advantageous when the bridges between the keys are very narrow. If the ultrasonic radiation lies in the low frequency range, there arises a spherical radiation, so that the receiver can be mounted not directly above the keyboard but even laterally.

There are available, further, loudspeakers on a piezo or electrodynamic basis which radiate not only in the audible, but also in the ultrasound range. A simple variant of the invention lies, therefore, in arranging such a speaker underneath the keyboard, so that the sound radiation passes through the slots between the keys and the key frame. An acoustic coupling with a key or the key frame is not necessary there. As receivers there are also usable electric microphones, the frequency range of which extends mostly into the ultrasound range. Another variant of the invention uses a reflector in place of the ultrasound receiver. Through the running time of the signals, the generator can be used in the manner of an echo probe for the delivery of short signals and then serve as receiver in a transmitting pause. As receiver instead of this a second ultrasound generator or an ultrasound transformer can be installed in the keyboard, so that generator and receiver are separate. Likewise it is possible to interchange the roles of generator and receiver either statically or dynamically.

For larger keyboards with many keys, it can be expedient to install in the keyboard several ultrasound generators that act in multiplex time on a common receiver. With use of a reflector with separate ultrasound generator and ultrasound receiver there result from the outset two monitoring points on the keyboard, the number of which can be increased by further generators and receivers.

It is also possible to dispense entirely with a receiver, as the radiation performance or the radiation resistance of the ultrasound generator is monitored. Through the damping of a superposed material more power is withdrawn from the generator and therewith a detection of an object on the keyboard is possible.

In addition to or in place of a signal monitoring, also the exciter signal can be modulated and the phase position of the modulation can be determined. Therewith manipulations can be precluded which receive a signal and radiate it again through a similar transmitter, which as a rule will lead of a phase displacement or running-time alteration and is thereby recognized. As modulation, a pseudo-rushing is very appropriate, because this cannot be simply imitated. Through a signal processor the then necessary correlation analysis can occur.

Instead of ultrasound there can also be used sound in the audible range, which preferably radiates from a separate loudspeaker present under the keyboard and is received by an electret microphone. Electronically generated pseudo-rushing has the advantage that it is not perceived by the user. Alternatives to this are impulses that act as crackling noise. In the event that an acoustic return report is given for a key actuation as a sound impulse or brief tone by a loudspeaker underneath the keyboard, this tone can be used as a sound signal. The same signal is generated outside of the transaction times at random spacings and evaluated, so that a covering-over of the keyboard is detected.

Also in the case of audible signals an interchange of transmitter and receiver is possible.

As transmitter there can also serve an electromagnetic tongue or small blade in the manner of a buzzer, which strikes against, for example, the key frame and therewith sets this in oscillations which are radiated from the key frame.

While the invention has been specifically described in connection with certain specific embodiments thereof, it is to be understood that this is by way of illustration and not of limitation, and the scope of the appended claims should be construed as broadly as the prior art will permit.

PARTS LIST

10 base plate
11 key frame
12*a* key
12*b* key
12*c* key
12*d* key
13 hood
14 ultrasonic transmitter or generator?
15 ultrasonic receiver

What is claimed is:

1. An arrangement for the detecting of an object that covers a surface of a keyboard, the arrangement comprising:

a sound generator provided in the keyboard and which radiates a signal into a space above the keyboard surface;

a sound receiver provided opposite the keyboard and within the radiation range of the sound generator, so that an object covering the sound generator weakens the signal arriving in the sound receiver; and the sound receiver is connected over an evaluating circuit with a control that is capable of blocking either the keyboard or an apparatus containing the keyboard.

2. The arrangement according to claim 1 wherein the sound generator and sound receiver are interchanged so that the sound receiver is provided in the keyboard and a sound generator is provided opposite the keyboard.

3. The arrangement according to claim 1 wherein the sound receiver is replaced by a sound reflector and the sound generator is replaced by a sound receiver.

4. The arrangement according to claim 1 wherein the sound generator and the sound receiver are used, alternating in time, as generator and as receiver.

5. The arrangement according to claim 1 wherein the sound receiver is replaced by a sound reflector and further comprises a sound transformer that serves as a sound receiver, that is executed in a manner similar to the execution of the sound generator, and that is likewise arranged in the keyboard.

6. The arrangement according to any of claims 1 to 5 and further comprising several sound generators or several sound receivers that are used alternating over time.

7. The arrangement according to claim 1 wherein the keyboard consists of a key frame, the outer side of which forms the surface of the keyboard outside of the keys, and in which the sound generator is mounted on the inside.

8. The arrangement according to claim 1 wherein the sound generator is installed from inside into a key head.

9. The arrangement according to claim 1 wherein the sound signal is an ultrasound signal.

10. The arrangement according to claim 1 wherein the key frame or a key head consists of piezoelectric material and on the undersurface there are mounted contacts for the excitation or for the reception of sound signals.

11. The arrangement according to claim 1 wherein the sound generator is an electrodynamic transformer that acts on a ferromagnetic object rigidly bound with the keyboard frame.

12. The arrangement according to claim 1 wherein the sound generator is an electrically excited tongue that transmits the sound waves over a loose connection with the key frame.

13. The arrangement according to claim 1 wherein the sound generator is a loudspeaker which is mounted underneath the keyboard.

14. The arrangement according to claim 1 wherein the sound generator alternates at random between transmitting and transmitting pause, and also the absence of a signal is evaluated in the transmitting pauses.

15. The arrangement according to claim 1 wherein the sound generator radiates modulated sound and the evaluating circuit also evaluates phase displacements or running time changes.

16. The arrangement for the detecting of an object covering the surface of a keyboard, comprising:

a sound generator provided in the keyboard and which radiates a signal into the space above the keyboard surface;

an evaluating circuit connected to the sound generator and which determines the radiation resistance, the radiated power or similar parameters of the sound generator; and a control connected to the evaluating circuit and which is capable of blocking the keyboard or an apparatus containing the keyboard.

17. The arrangement according to claim 16 wherein the keyboard consists of a key frame, the outer side of which forms the surface of the keyboard outside of the keys, and in which the sound generator is mounted on the inside.

18. The arrangement according to claim 17 wherein the sound generator is mounted in a blind hole in the keyboard made from the inside.

19. The arrangement according to claim 18 wherein the sound generator is a piezo transformer with radial oscillations and the oscillating frequency is attuned to the diameter of the blind hole and to the thickness of the remaining material for the purpose of resonance.

20. The arrangement according to claim 18 wherein the blind hole is admitted into a bridge between two keys.

21. The arrangement according to claim 16 wherein the sound generator is installed from inside into a key head.

22. The arrangement according to claim 16 wherein the sound signal is an ultrasound signal.

23. The arrangement according to claim 22 wherein the ultrasound signal lies in the range between 20 kHz and 100 kHz.

24. The arrangement according to claim 23 wherein the ultrasound signal is approximately 40 kHz.

25. The arrangement according to claim 16 wherein the key frame or a key head consists of piezoelectric material and on the undersurface there are mounted contacts for the excitation or for the reception of sound signals.

26. The arrangement according to claim 16 wherein the sound generator is an electrodynamic transformer that acts on a ferromagnetic object rigidly bound with the keyboard frame.

27. The arrangement according to claim 16 wherein the sound generator is an electrically excited tongue that transmits the sound waves over a loose connection with the key frame.

28. The arrangement according to claim 16 wherein the sound generator is a loudspeaker which is mounted underneath the keyboard.

29. The arrangement according to claim 16 wherein the sound generator alternates at random between transmitting and transmitting pause, and also the absence of a signal is evaluated in the transmitting pauses.

30. The arrangement according to claim 16 wherein the sound generator radiates modulated sound and the evaluating circuit also evaluates phase displacements or running time changes.

31. The arrangement according to claim 30 wherein the modulation occurs by a pseudo-rushing and the phase displacement is determined by correlation analysis.

32. The arrangement according to claim 30 wherein the transmitting signal is modulated and the evaluating circuit carries out an analysis of the envelope curve.

33. The arrangement according to claim 32 wherein the modulation occurs by audible sound.

34. The arrangement according to claim 16 wherein the signal of an acoustic return report presents the signal of the sound generator.

35. The arrangement according to claim 34 wherein signals of the acoustic return report are additionally radiated at times of the readiness for operation without keyboard actuation outside of transactions, preferably with randomly varied spacing of the time points.

36. The arrangement for the detecting of an object introduced into the space above a keyboard, in which in the space above a keyboard surface a sound field is generated, and in which a detector monitoring the sound field is connected with a control system which signals a disturbance of the sound field generated by an object introduced into the space.

37. The arrangement according to claim 36, characterized in that the detector monitors the delivery of one of sound energy and the radiation resistance of a sound generator.

38. The arrangement according to claim 37, characterized in that the detector serves also as sound generator.

* * * * *